US005207743A

United States Patent [19]

Costarella et al.

[11] Patent Number: 5,207,743

[45] Date of Patent: May 4, 1993

[54] DRINKING VESSEL SUPPORTING PLATE FOR ONE HAND

[76] Inventors: Joseph Costarella; Sumi Shohara, both of 368 Cavour St., Oakland, Calif. 94618

[21] Appl. No.: 902,983

[22] Filed: Jun. 23, 1992

[51] Int. Cl.[5] ..... B65D 73/00

[52] U.S. Cl. ..... 220/574; 220/575; 220/23.83; 206/515

[58] Field of Search ..... 220/574, 23.8, 575, 220/23.83, 23.4; 206/515

[56] References Cited

U.S. PATENT DOCUMENTS

| | | | |
|---|---|---|---|
| 2,427,697 | 9/1947 | Weidler . | |
| 4,732,274 | 3/1988 | Bouton | 220/23.8 |
| 4,823,958 | 4/1989 | Mahmud | 220/23.83 |
| 4,867,331 | 9/1989 | Task | 220/23.83 |
| 4,991,713 | 2/1991 | Phillips | 220/23.8 |
| 5,058,737 | 10/1991 | Patterson et al. | 220/574 |
| 5,111,960 | 5/1992 | Zilliox | 220/23.4 |
| 5,114,038 | 5/1992 | Quensen | 220/575 |

*Primary Examiner*—Joseph Man-Fu Moy

[57] ABSTRACT

A plate for serving food or holding other materials which contains a hole (35) at its center. The sides of the hole (30) are configured to hold a specific generic drinking vessel or specific generic liquid containing vessel, but will also hold other similarly shaped vessels. A recess (25), which surrounds the hole from beneath the plate, is shaped to allow the thumb and fingers of one hand to firmly grasp and hold the plate with or without the drinking vessel (40), (45) in place. The sides of the plate (15*a*) and (15*b*) are curved and sloped to allow the plate to be stacked with itself. The top of the recess (20) extends to the top level of the plate to prevent food from prematurely spilling over the plate's edge.

11 Claims, 2 Drawing Sheets

DRINKING VESSEL SUPPORTING PLATE FOR ONE HAND

BACKGROUND

1. Field of Invention

This invention relates to improvements in plates, specifically to a modification which will allow a plate and a drinking vessel to be held in one hand.

2. Description of Prior Art

Plates made of paper, plastic, and other materials are often used at buffets and parties to hold food. The plate is held in one hand leaving the other hand free to deliver food to the mouth. Drinks are also served at these events and if the party-goer is standing, which is often the situation, it becomes difficult, and usually impossible, to simultaneously hold the plate and cup and deliver food to the mouth. If the party-goer is holding the plate in one hand and a cup in the other hand he or she would have to put the plate or cup down before eating, shaking hands, or using the other hand.

Heretofore, an inventor has devised a way to combine a plate and a cup. U.S. Pat. No. 2,427,697 to Walter Weidler (1947) shows a plate with ring mounted at the plate edge to support a glass or cup. It is not clear if this plate with cup holder was supposed to be held in one hand. In order to hold this plate in one hand, the thumb would have to wrap around toe plate edge and extend along it. This method of holding a plate is difficult and quickly tires the hand, especially when there is a full cup and food adding weight to the plate. It is also difficult to balance and control the position of the cup because the hand is not proximate to the cup. Alternatively, the plate could be held from beneath with one or both hands. If held from below with one open hand, palm up, the plate would tend to lean in the direction of the cup and therefore be difficult to control. It is also difficult to firmly grasp a flat bottom plate from below. If held from the bottom with two hands, the advantage of freeing up one hand would be lost.

The shape of the supporting ring can only accommodate the cup it was designed to hold, thus requiring that a certain cup be used with the plate. Finally, the plate if made from paper or fibrous material, would have to be rigid enough to support the cup at the plate's edge.

OBJECTS AND ADVANTAGES

Accordingly, several objects and advantages of our invention are:

(a) to provide a plate which can be made of paper, fibrous material, metal, glass, or any other material suitable for making plates:

(b) to provide a plate with a hole at its center to support a drinking vessel;

(c) to provide a plate that can be easily held and stabilized with one hand;

(d) to provide a plate that can be used with or without a drinking vessel;

(e) to provide a plate that can hold a specific drinking vessel perfectly and hold other drinking vessels adequately;

(f) to provide a plate that can be stacked;

(g) to provide a plate that can be either mass produced using common and known technology or custom manufactured one at a time;

Further objects and advantages of our invention will become apparent from a consideration of the drawings and ensuing description of it.

DRAWING FIGURES

REFERENCE NUMERALS IN DRAWINGS

10—outside lip of our invention
15—serving portion of our invention
15*a*, 15*b*—side walls of serving portion
20—top of recess
25—finger and thumb recess
30—sloped surface for retaining drinking vessel
35—hole for drinking vessel
40—drinking vessel above plate
45—drinking vessel inserted in plate
50—Hand

DESCRIPTION—FIGS. 1 TO 5

Figure 1:
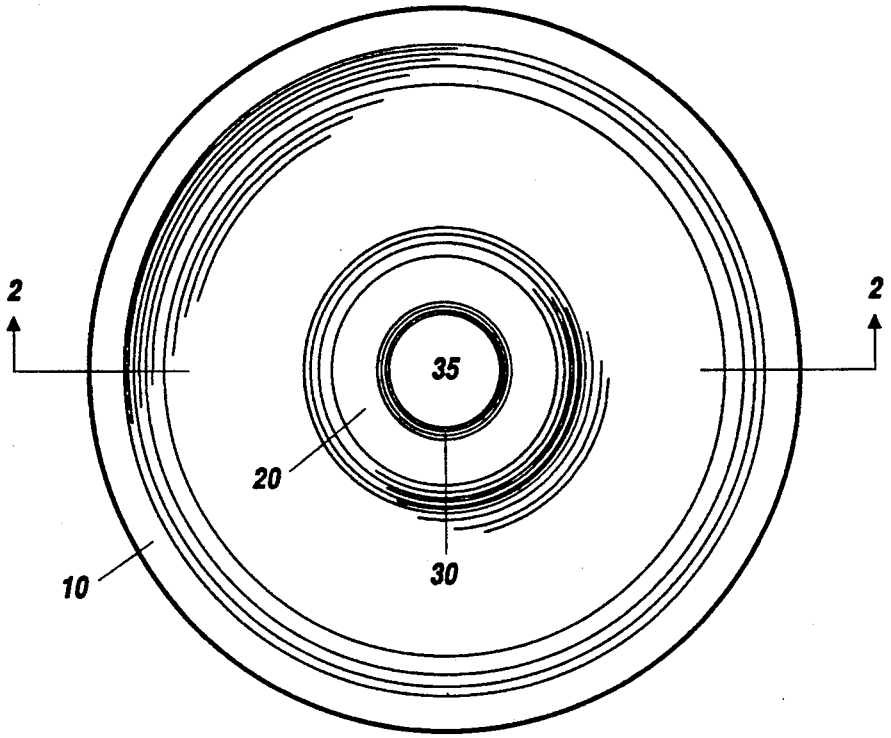
FIG. 1 is a top view of our invention.
Figure 2:
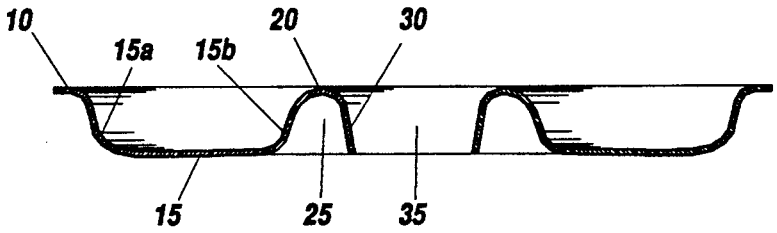
FIG. 2 is a cross section taken through the center of our invention.
Figure 3:
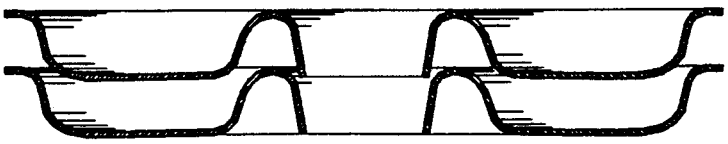
FIG. 3 is a cross section view showing how our invention stacks.
Figure 4:
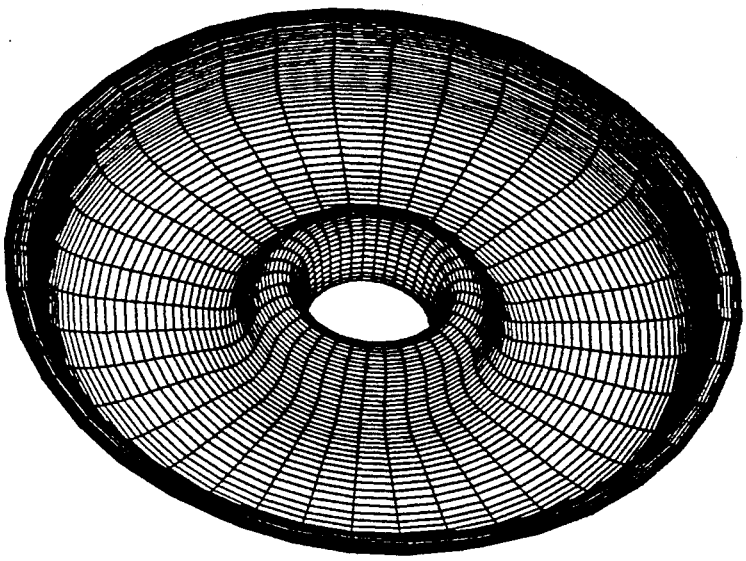
FIG. 4 is an Axonometric view of our invention.

FIGS. 1,2 and 4 illustrate our invention. Our invention has a lip 10 which is typical of plates, especially those made of fibrous or light weight materials. Our invention's bottom or serving section 15 should be as wide as possible. The diameter of our invention is approximately 12" and the depth is approximately 1". These dimensions can vary as long as there is enough room to hold a drinking vessel and a reasonable quantity of plate contents. The sides of the serving section 15*a* & 15*b* should be curved to allow our invention to be easily stacked, FIG. 3, and manufactured by conventional methods.

The top surface of the finger/thumb recess 20 extends to the top of our invention. The sloped surface of the hole 30 is angled to match a standard drinking vessel; although the hole 35 is designed to fit a specific drinking vessel most standard drinking vessels will fit into and be held by the sloped shape. The finger/thumb recess 25 is tapered to fit the shape of the fingers and thumb and to ease the manufacturing process. The bottom of the recess is about 1¼" across and the top of the recess is about ½" across. The actual dimension of the recess is not critical as long as it can accommodate the human hand.

Figure 5:
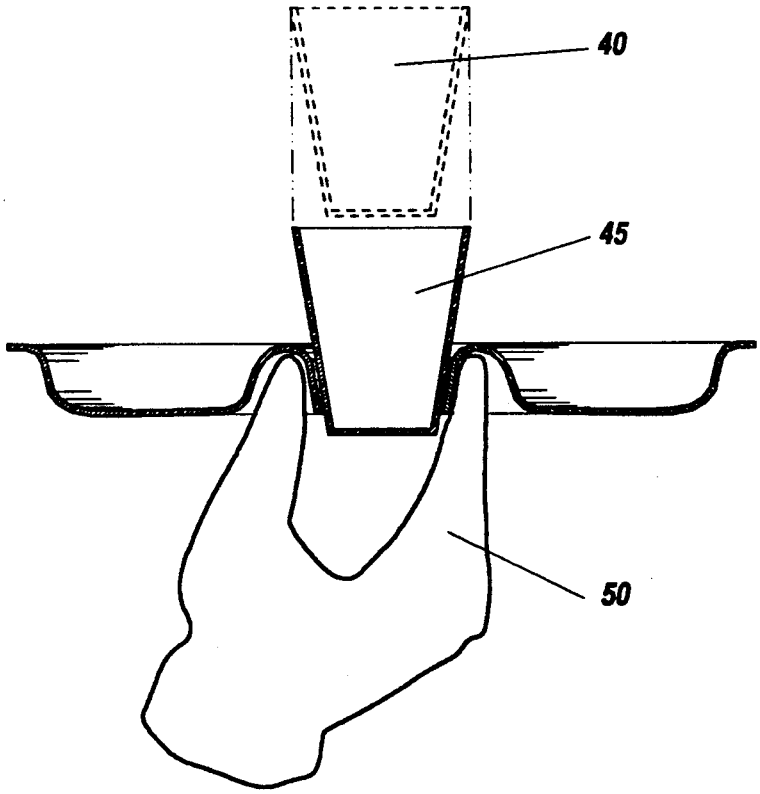
FIG. 5 is a cross sectional view showing a hand holding our invention and a drinking vessel as it would appear being inserted into our invention.

FIG. 5 shows a typical cross section of a hand 50 grasping our invention from beneath. The thumb and fingers fit into the recess 25. A standard drinking cup 40 is shown positioned above the hole in our invention and shown 45 inserted into the hole.

From the description above, a number of advantages of our invention become evident:

(a) The design of our invention enables it to be made of paper, fibrous material, metal, glass or any other material suitable for making plates.

(b) The tapered hole at the center will accommodate a specific, and many other similarly shaped, drinking vessels.

(c) The center position of the hole, the recessed grasping area, and the lip all help to reinforce the construction and provide a stable design thereby eliminating the need for heavy construction or for extremely stiff materials.

(d) The design allows our invention to be used with or without the drinking vessel.

(f) The design allows our invention to be stacked.

(g) Because our invention can be made of common, light weight materials and is made from one continuous piece, it can be easily produced using standard methods and easily mass produced at minimal cost.

OPERATION—FIGS. 1, 2, 3, 4, 5

Even though our invention is designed to be held in one hand and hold a cup, it can be simply used as an ordinary plate. Our invention can also be held in one hand by placing the fingers and thumb into the recess 25 and grasping the sloping sides of the hole 30. Since the top of the recess 20 extends to the top of our invention, food will not spill into the hole until it reaches the level of the lip 10.

The curved and sloping shape of our invention as shown in FIG. 2 allows our invention to be easily formed from one piece of material and either extracted from a mold or easily formed in a press. This shape also allows our invention to be stacked for storage or during original packaging and shipping.

If a party-goer wishes to place a cup or other drinking vessel into the hole 35, then the cup 40 or a similar drinking vessel is placed into hole 30 until the sides of the cup or vessel come into contact with the sloping sides 30 of the whole. The party-goer then grasps our invention with one hand 50. The centered position of the cup and the hand provides for an extremely stable condition allowing the party-goer to easily balance our invention and control the position of the cup, thus avoiding spillage of both plate contents and liquid from the cup.

With a cup or drinking vessel in place, the party-goer can easily move about the party or event and use his or her free hand to: eat from our invention, shake hands, remove the cup for a drink, or perform any other useful task.

SUMMARY, RAMIFICATIONS, AND SCOPE

Accordingly, the reader will see that our invention can be conveniently held in one hand and that a standard cup of specific design and most other drinking vessels can be securely held at the center of our invention. Furthermore, our invention has the additional advantages in that

- it can be mass produced from a variety of materials, such as paper and other fibrous materials, metal, plastic, etc;
- it can be produced in a variety of colors and decorative patterns;
- it allows plastic, paper, and other inexpensive, mass produced party and buffet drinking vessels to be inserted into it;
- It can be used with or without the drinking vessel; and
- It can be stacked for shipping or storage.

Although the description above contains many specificities, these should not be construed as limiting the scope of the invention, but as merely providing illustrations of some of the presently preferred embodiments of our invention. For example, our invention can have other shapes, such as oval, square, triangular, etc.; or our invention can be divided into sections with partitions in order to segregate its contents. Our invention can also be used to hold water paint and water or to help serve food and liquid to infants or invalids.

Thus the scope of our invention should be determined by the appended claims and their legal equivalents, rather than by the examples given.

We claim:

1. A one-hand supported plate comprising in combination:

(a) a generally flat surface having a upwardly projecting peripheral retaining lip; and (b) a hole generally centered in said flat surface, sides of said hole form a surface to support a drinking vessel, said sides of hole do not extend above said retaining lip and below said flat surface; and (c) a peripheral recess on the underside of said flat surface surrounding said hole and partially forming said sides of said hole, said recess having a sufficient shape forming a gripable surface to be grasped by the fingers and thumb of one hand.

2. In claim 1 wherein said plate is for holding food, paints or other materials and said drinking vessel is for holding beverages, paint thinner or other liquids.

3. In claim 1 wherein said sides of hole are configured to precisely hold a generic, already manufactured drinking vessel, but will also adequately support other common drinking vessels having similar shapes.

4. In claim 1 wherein said gripable surface can be gripped by the fingers and thumb of one hand with the palm of said hand facing upward and below said hole and in contact with bottom of said drinking vessel.

5. In claim 1 wherein said plate has a shape that permits said plate to be stacked on top of a duplicate of said plate.

6. In claim 5 said plate is approximately 1 inch in height, thereby minimizing stacking height, material of manufacture, and weight of said plate.

7. In claim 1 wherein said plate is formed from a single sheet of material.

8. In claim 6 said material can be plastic, glass, wood, fibrous materials or any other material suitable for fashioning plates.

9. In claim 1, further including partitions in said plate for segregating contents of said plate.

10. In claim 1 wherein said plate's shape allows it to be easily mass produced using a common manufacturing process.

11. In claim 1 wherein said plate's shape allows it to be used as a normal plate without said drinking vessel in place.

* * * * *